US006351881B1

(12) United States Patent
Peckich et al.

(10) Patent No.: US 6,351,881 B1
(45) Date of Patent: Mar. 5, 2002

(54) HINGE PIN REMOVER AND STARTER

(76) Inventors: Ronald S. Peckich, 3232 Springarden Rd., Pgh., PA (US) 15212; Vincent G. Motta, 117 Laporte, Cranberry Township, PA (US) 16066

( * ) Notice: Subject to any disclaimer, the term of this patent is extended or adjusted under 35 U.S.C. 154(b) by 0 days.

(21) Appl. No.: 09/716,057

(22) Filed: Nov. 20, 2000

(51) Int. Cl.[7] ..... B25B 27/14

(52) U.S. Cl. ..... 29/275; 254/131; 254/25; 29/278; 81/52.3

(58) Field of Search ..... 145/46; 254/131, 254/25; 29/275, 278, 253, 254, 255, 276, 280; 81/52.3, 52.35

(56) References Cited

U.S. PATENT DOCUMENTS

| | | | | |
|---|---|---|---|---|
| 3,166,757 A | | 1/1965 | Downs | |
| 3,602,969 A | | 9/1971 | Provost | |
| 3,689,977 A | | 9/1972 | Crabbe | |
| 4,188,701 A | | 2/1980 | Ludwig | |
| 4,627,141 A | | 12/1986 | Tesker | |
| D350,270 S | | 9/1994 | Jensen | |
| 5,438,743 A | * | 8/1995 | Simington et al. | 29/275 |
| 5,875,535 A | * | 3/1999 | Canoy | 29/275 |
| 5,896,607 A | | 4/1999 | Hagen | |

FOREIGN PATENT DOCUMENTS

| | | | |
|---|---|---|---|
| GB | 2075410 | * 11/1981 | 29/275 |

* cited by examiner

*Primary Examiner*—Joseph J. Hail, III
*Assistant Examiner*—Daniel Shanley
(74) *Attorney, Agent, or Firm*—William P. Smith

(57) ABSTRACT

A hinge pin removal and starter device is disclosed, comprising a bar portion having a first and second end portion. The first end portion of said bar tapers to a flattened tip having a concave edge. A cylindrical projection adjacent the opposite butt end protrudes from said second end portion a generally perpendicular direction thereto. The tip of said first end portion is adapted for forcible insertion between the head of a hinge pin and a hinge, to wedge the hinge pin and hinge apart and detach said pin from said hinge plate. The cylindrical projection adjacent said second end portion is adapted to be placed in abutting relation to said pin opposite the head of said pin and a force applied against the pin through the cylindrical projection, to at least partially displace said pin from the hinge plate into which the pin is inserted.

In a preferred embodiment, wherein a hinge pin having a head, a distal end and a cylindrical stem portion; the flat tip has a concavely curved edge, such that when inserted between the head of said hinge pin and the hinge plate, the curvature of said concavely curved edge of said tip permits the flat tip to engage the underside of said hinge pin head and the curved side of said cylindrical stem portion to maximize the contact area of the tip against the head of the hinge pin, and prevents lateral slippage against the cylindrical stem portion.

5 Claims, 3 Drawing Sheets

HINGE PIN REMOVER AND STARTER

FIELD OF THE INVENTION

The present invention relates to a tool for removing door hinge pins and more particularly to a hinge pin remover with an integral pin starter mounted thereon.

BACKGROUND OF THE INVENTION

U.S. Pat. No. 5,896,607 discloses a multi-purpose hinge pin remover which can also be used as a pry bar. The hinge pin remover has a hand guard, a hammer head, and two additional working surfaces.

U.S. Pat. No. 4,627,141 discloses a hinge pin remover comprising an elongated shaft. The first end of the shaft is adapted to be driven by hammer means, the second end of the shaft forming a flat end having a thickness substantially less than the diameter of the shaft and having a depression therein. The shaft is bent intermediate the first and second ends to form an obtuse angle such that the first end of the shaft points upwardly.

U.S. Pat. No. 4,188,701 discloses a hinge pin remover including a tool having a wedge shaped head mounted on a shank equipped with a support projection to receive a hinge. Striker plate 14 perpendicular to shank 11 receives impact blows to dislodge a hinge pin.

U.S. Pat. No. 3,689,977 discloses a sturdy driver type device having an enlarged head 7 on one end of body 6 and a V-shaped chisel blade 8 with a V-shaped notch 9.

U.S. Pat. No. 3,166,757 discloses an off-set driving tool having body member 10 integrally joined to handle 11. Web 15 joins anvil portion 12 with driving end and fulcrum end portions. Handle 11 includes legs 40 joined with central portion 41 to dampen vibrations when the tool is struck a driving blow.

Design Patent 350,270 discloses an ornamental design for a hinge pin remover.

SUMMARY OF THE INVENTION

A hinge pin removal and starter device is disclosed, comprising a bar portion having a first and second end portion. The first end portion of said bar tapers to a flat tip. A cylindrical projection adjacent the opposite butt end protrudes from said second end portion a generally perpendicular direction thereto. The tip of said first end portion is adapted for forcible insertion between the head of a hinge pin and a hinge, to wedge the hinge pin and hinge apart and detach said pin from said hinge plate. The cylindrical projection adjacent said second end portion is adapted to be placed in abutting relation to said pin opposite the head of said pin and a force applied against the pin through the cylindrical projection, to at least partially displace said pin from the hinge plate into which the pin is inserted.

In a preferred embodiment, wherein a hinge pin having a head, a distal end and a cylindrical stem portion; the flat tip has a concavely curved edge, such that when inserted between the head of said hinge pin and the hinge plate, the curvature of said concavely curved edge of said tip permits the flat tip to engage the underside of said hinge pin head and the curved side of said cylindrical stem portion to maximize the contact area of the tip against the head of the hinge pin, and prevents lateral slippage against the cylindrical stem portion.

The object of this invention is to provide a wedge removal tool having a pin protruding from one end adapted to fit into a hinge and drive a hinge pin into or from said hinge.

Another object is to provide a convenient device to force a pin out of a door hinge for removing a door.

Yet another object is to provide a tool which makes removal of a rusted or painted hinge pin easier to remove.

Yet another object is to provide a hinge pin remover that quickly and easily dislodges a pin from a hinge, thus allowing for quick and easy removal of same. Further, an object of the present invention is to provide a convenient tool for removing newer door hinges which include starting holes.

DETAILED DESCRIPTION OF THE INVENTION

Figure 1:
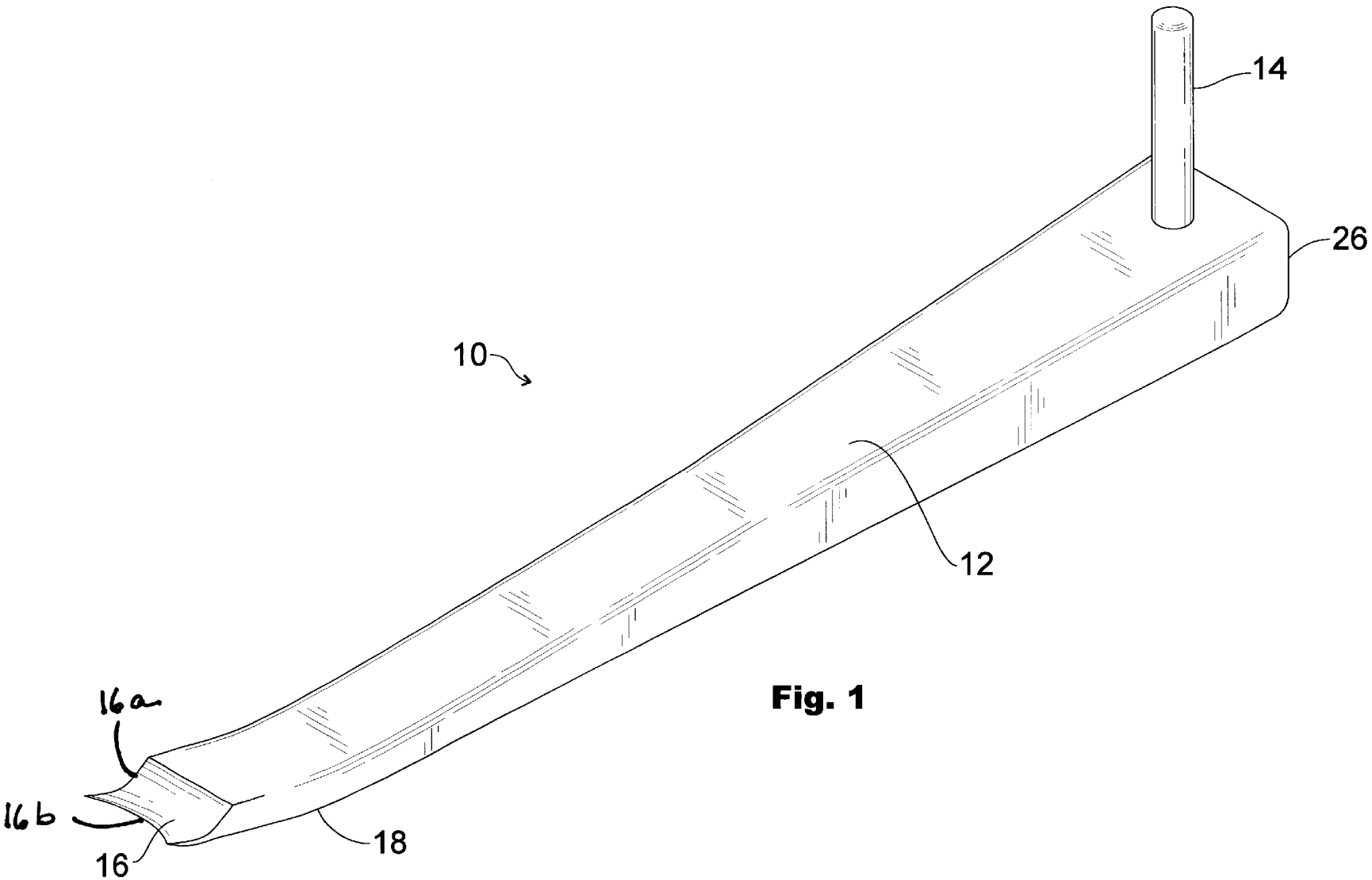
FIG. 1 illustrates a top isometric view of the invention.

Referring first to FIG. 1, a hinge pin remover/starter generally designated as 10, is shown. An elongated bar portion 12 forms the body of the tool 10. Bar portion 12 is generally a flat piece of bar tapering slightly from a flattened tip 16 to the opposite end 26. At the flattened tip 16, a sharp wedged portion 16*a* is formed with a concave edge 16*b* along the tip 16. A fulcrum point 18 is formed by a slight bend in the bar portion 12 nearer the first end portion 16. At the second end portion 26, the bar tapers to its widest point and a pin starter portion 14 projects outwardly from the flat bar portion 12. Pin starter portion 14 is a short cylindrical projection of a dimension such that the diameter of pin starter portion 14 is less than that of the annular portion of a door plate hinge 30.

Figure 2:
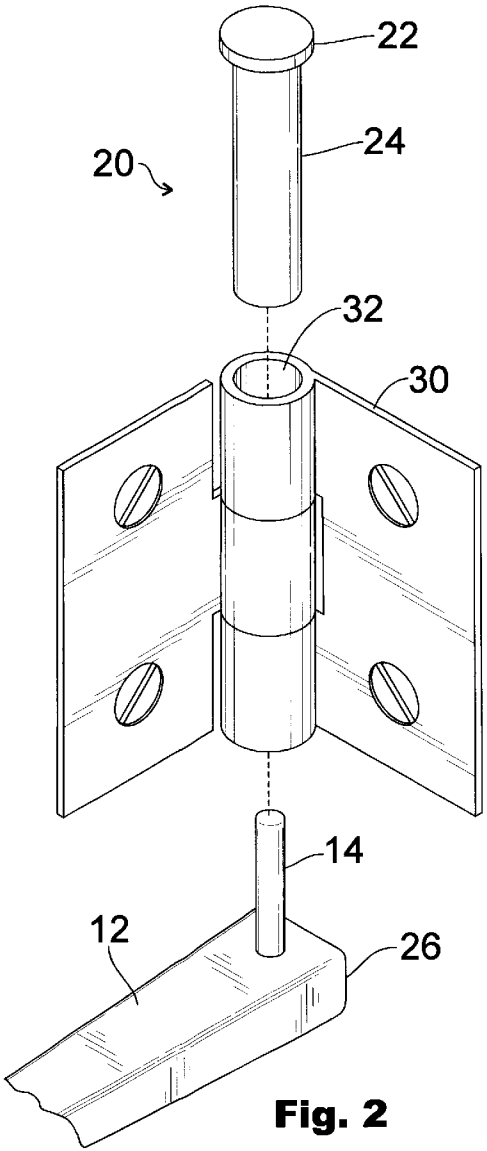
FIG. 2 shows an exploded view of a hinge, a pin, and the pin starter in alignment.

Referring to FIG. 2, door plate hinge 30 has an annular portion 32 adapted to receive hinge pin 20 in such a way that when the cylindrical shaped hinge pin 20 is inserted in annular portion of plate hinge 30, they are rotatable attached about the hinge 30 vertical axis in a snug fitting relation. The pin starter portion 14 when placed in alignment with pin 20 may be placed in abutting relationship with the cylindrical pin 20 in order to force hinge pin 20 into annular portion 32 of plate hinge 30, or as a means of removing hinge pin 20.

Figure 3:
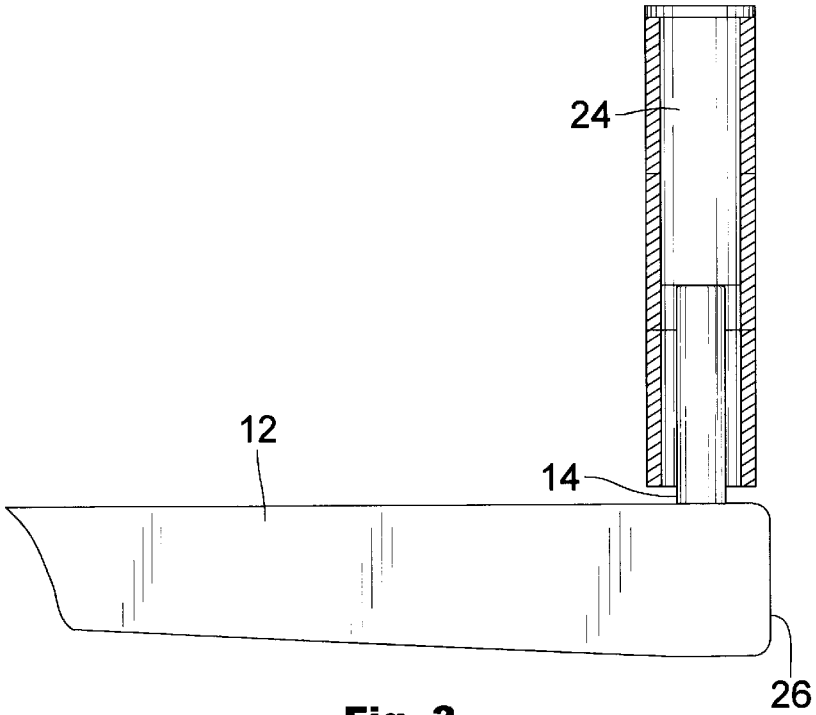
FIG. 3 illustrates an elevational view of the pin starter inserted into the annular portion of the hinge to drive a pin therefrom.

Referring now to FIG. 3, bar portion 12 projects approximately at a right angle outwardly from the annular portion of plate hinge 30. A hinge pin 20 inserted within the annular portion 32 of plate hinge 30 is forced outwardly from the plate hinge 30 by placing pin starter portion 14 in abutting relationship with hinge pin 20 and forcing the pin 20 upward and out of plate hinge 30. A hammer or other tool may be used to strike the pin to provide extra impulse where the pin has become fixed in position within plate hinge 30 due to rust, paint, or other corrosive influences.

Figure 4:
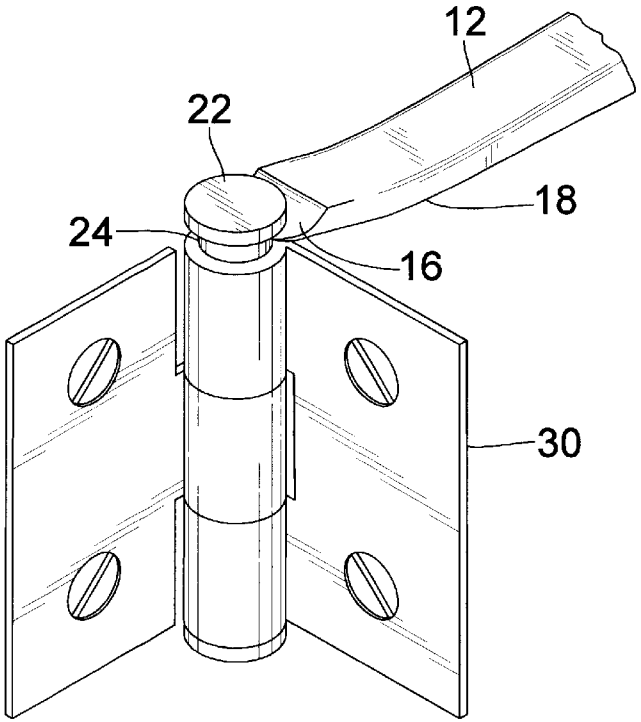
FIG. 4 is an isometric view illustrating the pin remover tip wedged beneath the head of a pin inserted into a door hinge.

Referring now to FIG. 4, the curved end portion 16 of first end portion 18 is inserted beneath the head portion 22 of hinge pin 20, in a wedge fashion in order to apply an upward force to assist in removal of hinge pin 20 from plate hinge 30. The bent portion provides a fulcrum by which bar portion 12 applies leverage to increase the upward force and assist in the removal of hinge pin 20.

Figure 5:
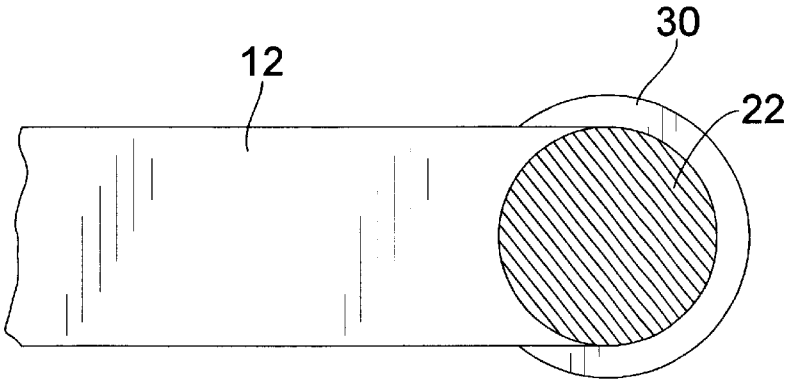
FIG. 5 is a top plan view of the wedged portion seated beneath the pin top portion above the hinge annular portion.

Referring now to FIG. 5 a top plan view illustrates the advantage of the curvature in curved end portion 16 which allows the curved end portion 16 to be in contact with the cylindrical stem portion 24 of hinge pin 20 so as to apply force against approximately one-half of cylindrical portion 24 of pin 20, beneath head portion 22, thereby increasing the overall vertical force applied by bar 12 when wedged beneath the pin head 22.

According to the provisions of the patent statutes, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. A hinge pin removal and starter device, comprising:

An elongated bar portion having a first and second end portion;

said first end portion of said bar tapering to a flat tip;

said device also having a slight bend in said bar portion adjacent said first portion along the longitudinal axis, to provide a fulcrum for additional leverage when prying a hinge pin from its position;

a cylindrical projection adjacent said second end portion and protruding from said bar portion in a generally perpendicular direction thereto;

such that the tip of said first end portion may be forcibly inserted between a head of a hinge pin and a hinge, to wedge the hinge pin and hinge apart and detach said pin from said hinge plate; and the cylindrical projection of said second end portion may be placed in abutting relation to said pin opposite the head of said pin and a force applied against said pin to at least partially displace said pin from the hinge plate into which the pin is inserted.

2. The hinge pin remover and starter device of claim 1, wherein also comprising:

said hinge pin having a head, a distal end and a cylindrical stem portion;

said flat tip having a concavely curved edge, such that when inserted between the head of said hinge pin and the hinge plate, the curvature of said concavely curved edge of said tip permits the flat tip to engage the underside of said hinge pin head and the curved side of said cylindrical stem portion to maximize the contact area of the tip against the head of the hinge pin, and to prevent lateral slippage against the cylindrical stem portion.

3. The hinge pin remover and starter device of claim 1, wherein said bar portion comprises a gauged metal bar forming a slender, slightly tapering, rigid wedge tool.

4. The hinge pin remover and starter device of claim 1, wherein said protruding cylindrical portion has a diameter not greater than said hinge pin, to permit insertion of said cylindrical projection into a hinge plate, for displacement of the hinge pin.

5. The hinge pin remover and starter device of claim 1, wherein said flat tip terminating in a sharply tapered wedge point, said wedge point having a concave horizontal edge.

* * * * *